United States Patent [19]

Griffin

[11] 4,176,838

[45] Dec. 4, 1979

[54] BATTING BASEBALL TEE

[76] Inventor: Jacqulyn G. Griffin, 60 Helen La., Fort Myers Beach, Fla. 33931

[21] Appl. No.: 842,942

[22] Filed: Oct. 17, 1977

[51] Int. Cl.[2] ..... A63B 69/40

[52] U.S. Cl. ..... 273/26 E

[58] Field of Search ..... 273/26 R, 26 E, 29 A, 273/33, 206, 207, 208, 58 C, 95 A; 272/76, 77, 78; 220/208, 306, 356; 46/155; 113/120 L, 120 A, 120 C, 120 AA

[56] References Cited

U.S. PATENT DOCUMENTS

| | | | |
|---|---|---|---|
| 1,007,628 | 10/1911 | Armstrong | 272/76 |
| 1,481,594 | 1/1924 | Fitzgerald | 272/76 |
| 2,458,306 | 1/1949 | Schneider | 273/26 R |
| 2,984,382 | 5/1961 | Florsheim, Jr. | 220/306 |
| 3,039,770 | 6/1962 | Ferretti | 273/26 R |
| 3,874,662 | 4/1975 | Harrington | 273/26 E |

FOREIGN PATENT DOCUMENTS

| | | | |
|---|---|---|---|
| 249639 | 4/1926 | United Kingdom | 273/207 |

*Primary Examiner*—Richard C. Pinkham
*Assistant Examiner*—T. Brown
*Attorney, Agent, or Firm*—Alfred E. Wilson

[57] ABSTRACT

A batting baseball tee comprised of a self-righting, semi-spherical weighted bottom portion with an axially upstanding post removably fixed thereto, terminating at its upper end with an inverted conical helical spring attached thereto for the reception of a ball forming a batting target.

1 Claim, 3 Drawing Figures

BATTING BASEBALL TEE

BACKGROUND OF THE PRESENT INVENTION

The present invention pertains to a device for supporting a ball on its upper end to provide a target for batting practice for a single child, or for use in a variety of modified baseball games with two or more participants.

A string may be attached between the ball and the device for use by a single child. The string comprises a means for retrieving the ball after it has been hit.

For two or more players, various modified, competitive types of baseball games may be played utilizing fielders and one or more bases. In this event two sides or teams of one or more children would alternate in turns at bat and in the field. With one child on each side, one base is used and the batter, after hitting the ball from the top of the tee, must run to base and back to home (the tee) before the fielder retrieves the ball and reaches home or tags the batter out.

With two or more children on each side, at least two bases can be used and the batter need not return home on his or her hit, but can wait to be driven in by a subsequent batter.

The batting tee device of the present invention is intended primarily for relatively young children who cannot pitch well, for example, from three or four to eight years of age. It provides the youngsters at an early age with practice relative to a proper batting stance, aim at the ball, team work and game rules. A game played with the tee device holds the interest of the players as well as the spectators and is particularly useful by boys and girls from kindergarten age through the third grade or older. At home Dad can assist Junior and establish an early-in-life father-son closeness.

Therefore, one of the principal objects of the present invention is to provide for youngsters early instruction in competitive sports in a baseball game which they can handle, namely because it requires no ball pitching.

Another object of the invention is to provide a batting baseball tee which is limber and self-righting especially on a bad batting hit, said tee being provided with a weighted-down self-righting base with a generally waist-high upstanding ball support post, removably attached thereto whereby the post may be removed and replaced by a post of a different height for use by taller or shorter children.

Yet another object of the present invention is to provide an inverted, limber conical helical spring in fixed attachment to the top end of the post to support a ball.

DETAILED DESCRIPTION OF A PREFERRED EMBODIMENT

Figure 1:
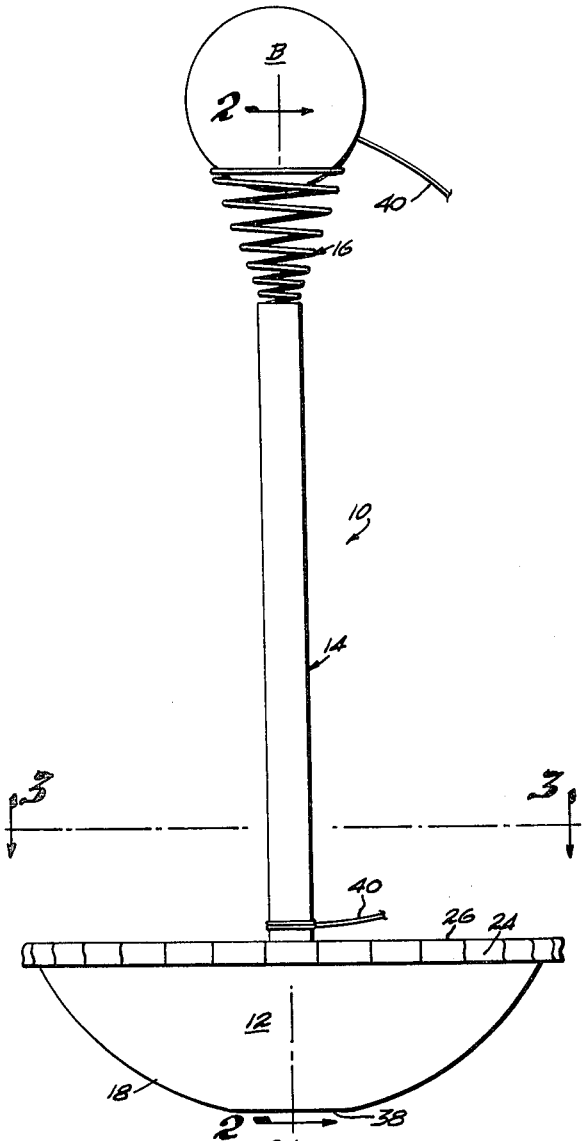
FIG. 1 is a side elevational view of the batting baseball tee of the present invention.

With reference to the drawings, inwhich like reference characters designate like or corresponding parts throughout the several views, the numeral 10 generally designates the batting baseball device of the present invention. The device is comprised of a semi-spherical self-righting bottom portion 12, an upright post 14 and an inverted, conical helical spring 16 fixed to the top end of post 14.

In more detail the semi-spherical bottom portion 12 is comprised of a semi-spherical shell 18 containing a heavy substance such as pebbles or concrete 20, for example. To check a sideway fall, a peripheral outwardly extending flange 22 is provided from the edge of shell 18 for engagement by a turned down spring flange 24 of a snap-on lid 26 which includes a central clearance hole 27 for post 14.

The bottom end of upright post 14 is threaded at 28 for reception in an internally threaded receptacle 30, axially secured within the bottom of shell 18 in any conventional means such as by rivets, spot weld or integral molded plastic 32. At its upper end, the post is joined securely to the bottom turns 33 of the inverted conical helical spring 16 in any conventional manner such such as by the engagement of the bolt 34 of a nut and bolt assembly in a plug 36, force fitted within the tubular post 14. It should be here noted that the post 14 may be fabricated of any appropriate plastic, metal or wood structure, and the shell 18 may be of any appropriate plastic or metal material. Any of a variety of conventional attachment means between the post 14 and the shell 18 and spring 16 may be utilized to accommodate the choice of materials.

Figure 2:
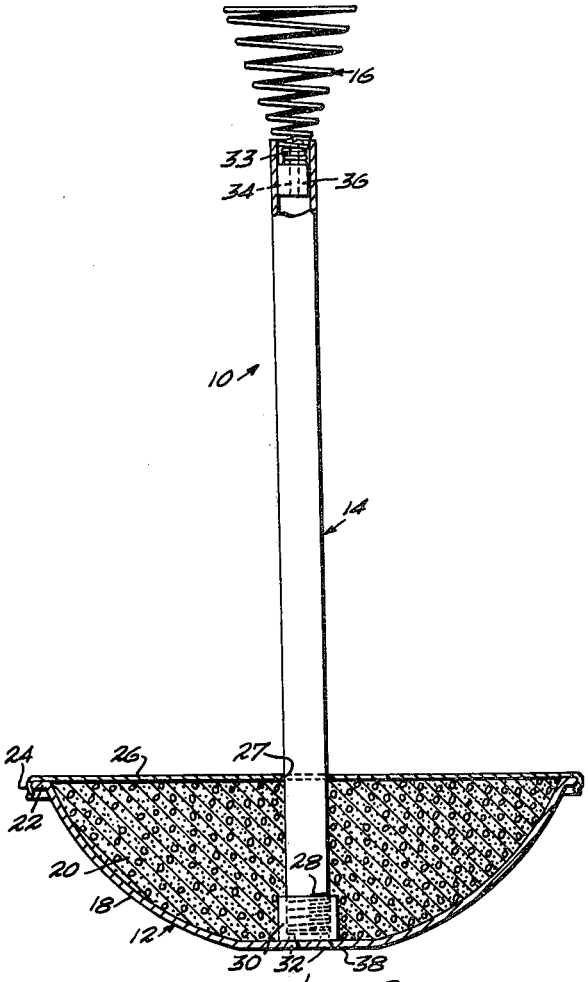
FIG. 2 is a vertical cross sectional view taken along line 2—2 of FIG. 1.
Figure 3:
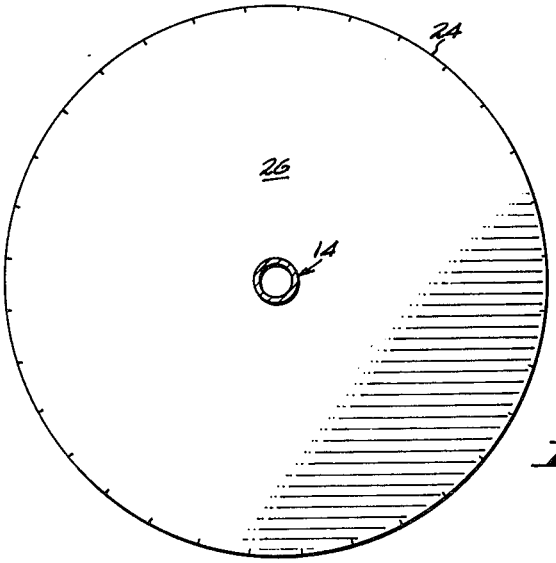
FIG. 3 is a cross sectional view taken along line 3—3 of FIG. 1

As illustrated in FIGS. 1 and 2, a relatively small flattened area 38 is provided at the bottom of shell 18 to provide stability for the device while a child is aiming a bat at a ball B disposed atop conical spring 16 as in FIG. 1.

As further illustrated in FIG. 1, a string 40 may be attached between the ball B and the post 14 as an aid in retrieving the ball after it has been struck by a user.

The post 14 may be turned to break it loose from the concrete 20 prior to its completely setting to permit its removal after the concrete is completely set, or, alternatively a tubular member (not shown) surrounding the receptacle 30 and extending upwardly to the depth of the concrete may be provided to completely isolate the central area occupied by post 14.

I claim:

1. A batting base ball tee device comprising a self uprighting base member comprised of an upwardly hollow shell, providing a hemi-spherical bottom, with a flattened central area, said shell being filled with a suitable heavy material, a post of a predetermined height having a top end, and a screw threaded lower end engaged in an internally screw threaded receptacle fixed centrally and interiorly of said shell, an inverted conical helical spring fixed to said top end in an axial relation to said post and shell for nestingly receiving a ball.

* * * * *